US006637223B2

(12) United States Patent
Ota et al.

(10) Patent No.: US 6,637,223 B2
(45) Date of Patent: Oct. 28, 2003

(54) CONTROL APPARATUS FOR VARIABLE DISPLACEMENT COMPRESSOR

(75) Inventors: Masaki Ota, Kariya (JP); Kazuya Kimura, Kariya (JP); Yoshinobu Ishigaki, Kariya (JP); Kazuhiro Nomura, Kariya (JP); Tomoji Tarutani, Kariya (JP); Masahiro Kawaguchi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/045,261

(22) Filed: Nov. 7, 2001

(65) Prior Publication Data

US 2002/0069658 A1 Jun. 13, 2002

(30) Foreign Application Priority Data

Nov. 8, 2000 (JP) ..... 2000-339903

(51) Int. Cl.[7] ..... F25B 1/00; F25B 49/00
(52) U.S. Cl. ..... 62/158; 62/228.3; 417/222.2
(58) Field of Search ..... 62/228.3, 228.5, 62/158; 417/222.2

(56) References Cited

U.S. PATENT DOCUMENTS 5,785,502 A * 7/1998 Ota et al. ..... 417/222.2
5,873,707 A * 2/1999 Kikuchi ..... 417/309
6,434,956 B1 * 8/2002 Ota et al. ..... 62/228.3

FOREIGN PATENT DOCUMENTS

EP 0 945 618 A2 9/1999 ..... F04B/27/18

OTHER PUBLICATIONS

U.S. patent application Ser. No. 09/948,356, filed Sep. 7, 2001.

* cited by examiner

*Primary Examiner*—William Wayner
(74) *Attorney, Agent, or Firm*—Morgan & Finnegan, LLP

(57) ABSTRACT

A control apparatus that promptly increases the displacement of a compressor after the compressor is started while liquefied refrigerant is lingering in an external circuit. The control apparatus includes a restricting passage. The restricting passage is located in a first pressure introduction passage, through which the pressure of the first pressure monitoring point flows to the control valve. The restricting passage decreases the pressure of refrigerant that flows through the passage. When the compressor is started while liquefied refrigerant is lingering in the external circuit and the pressure of the first pressure monitoring point is abruptly increased, the restricting passage reduces the increase of the pressure that is detected by the control valve. Therefore, the displacement of the compressor is promptly increased.

15 Claims, 3 Drawing Sheets

CONTROL APPARATUS FOR VARIABLE DISPLACEMENT COMPRESSOR

BACKGROUND OF THE INVENTION

The present invention relates to a control apparatus for controlling the displacement of a variable displacement compressor that forms a refrigerant circuit of a vehicle air-conditioning system.

The displacement of a variable displacement compressor is controlled by a control apparatus, which has a control valve. The control valve includes a pressure sensing mechanism and a solenoid for moving a valve body. The pressure sensing mechanism detects the pressure at a pressure monitoring point in a discharge pressure zone of a refrigerant circuit. The pressure sensing mechanism moves the valve body such that the displacement of the compressor is changed to prevent the fluctuations of the pressure. The current supplied to the solenoid is externally controlled to change a target pressure, which is the base for determining the position of the valve body.

When the compressor is started while liquefied refrigerant is lingering in the refrigerant circuit, the compressor compresses the liquefied refrigerant. This increases the pressure in the discharge pressure zone of the refrigerant circuit, or at the pressure monitoring point, abruptly and excessively. Even if the target pressure is maximized by the control valve, the pressure at the pressure monitoring point exceeds the maximized target pressure. The pressure sensing mechanism moves the valve body to prevent the excessive increase of the pressure. Therefore, the compressor cannot increase the displacement promptly after being started while liquefied refrigerant is lingering in the refrigerant circuit. Thus, the liquefied refrigerant in the compressor is not discharged outside promptly. As a result, vibration and noise are generated for a long time by compressing the liquefied refrigerant.

BRIEF SUMMARY OF THE INVENTION

The objective of the present invention is to provide a control apparatus that increases the displacement of a compressor promptly even when the compressor is started while liquefied refrigerant is lingering in a refrigerant circuit.

To achieve the foregoing objective, the present invention provides a control apparatus for controlling the displacement of a variable displacement compressor that forms a refrigerant circuit of an air-conditioning system. The refrigerant circuit includes the compressor, an external circuit, and a discharge pressure zone, which communicates the compressor and the external circuit and is exposed to refrigerant gas that is discharged from the compressor to the external circuit. The control apparatus includes a control valve and a pressure reducing mechanism. The control valve includes a valve body, a pressure sensing mechanism, and a target pressure changing member. The pressure sensing mechanism has a pressure sensing member and detects the pressure at a pressure monitoring point located in the discharge pressure zone in the refrigerant circuit. The pressure sensing mechanism displaces the pressure sensing member in accordance with the fluctuations of the pressure at the pressure monitoring point such that the pressure at the pressure monitoring point is equal to a target pressure, which is a criteria for determining the position of the valve body. The valve body moves accordingly to cancel the fluctuations of the pressure and thus the displacement of the compressor is changed. The target pressure changing member changes the target pressure by controlling the external force applied to the pressure sensing member. The pressure reducing mechanism draws the pressure at the pressure monitoring point to the pressure sensing mechanism. The pressure reducing mechanism is located in a passage that connects the pressure monitoring point and the pressure sensing mechanism. When the pressure at the pressure monitoring point abruptly increases, the pressure reducing mechanism reduces the increase of the pressure that is detected by the pressure sensing mechanism.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which.

DETAILED DESCRIPTION OF THE PREFERRED EMBODIMENTS

A control apparatus for a swash plate type variable displacement compressor provided in a vehicle air-conditioning system according to a first embodiment and a second embodiment of the present invention will be described with reference to FIGS. 1 to 5. Like members are given the like numbers in the figures. As for the second embodiment, only the parts different from the first embodiment are explained.

First Embodiment (Swash Plate Type Variable Displacement Compressor)

Figure 1:
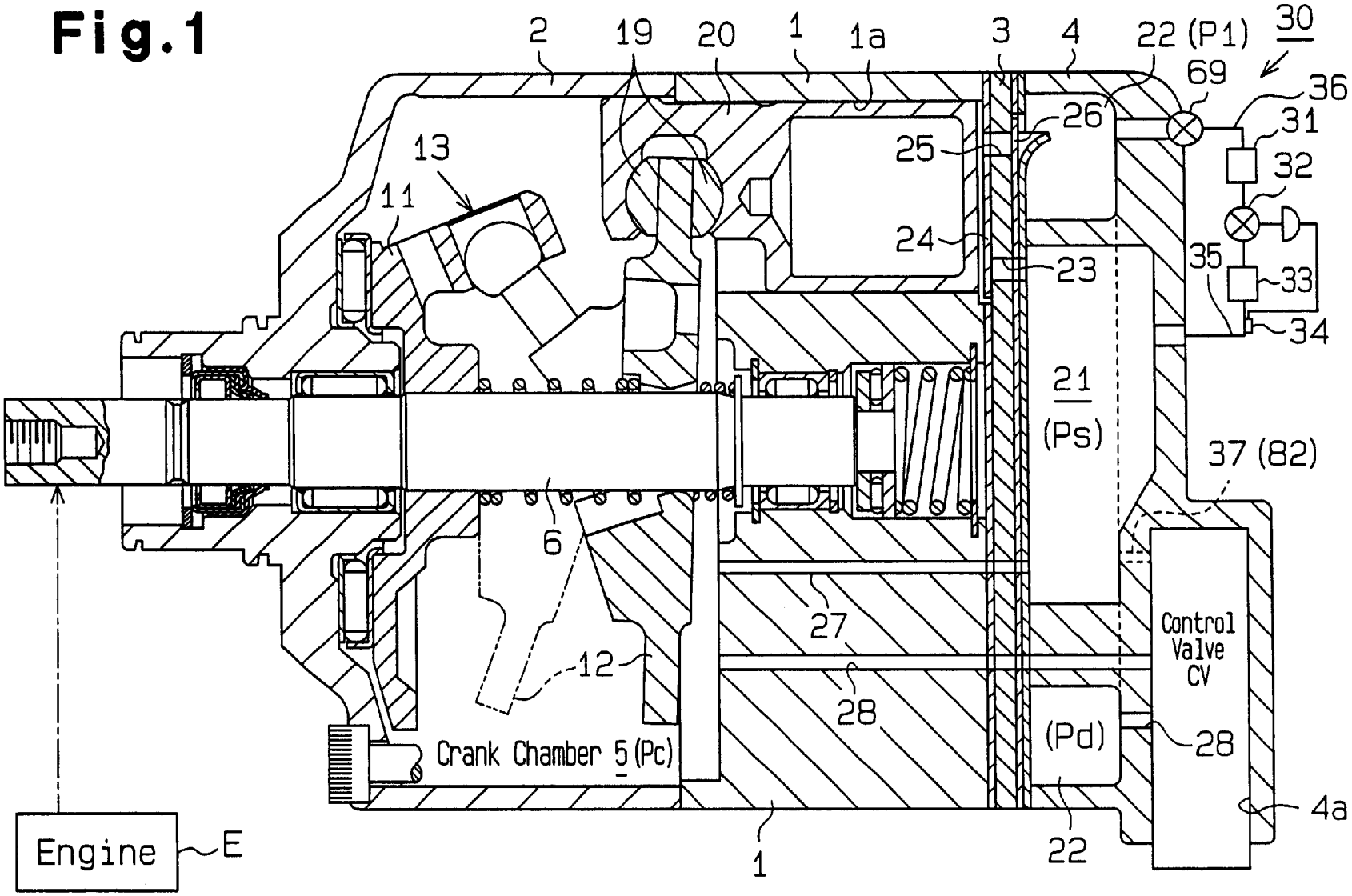
FIG. 1 is a cross-sectional view illustrating a swash plate type variable displacement compressor.

As shown in FIG. 1, a swash plate type variable displacement compressor includes a cylinder block 1, a front housing 2, and a rear housing 4. The front housing 2 is fixed to the front end of the cylinder block 1. The rear housing 4 is fixed to the rear end of the cylinder block 1. A valve plate assembly 3 is located between the cylinder block 1 and the rear housing 4.

The cylinder block 1 and the front housing 2 define a crank chamber 5. A drive shaft 6 is rotatably located in the crank chamber 5. The drive shaft 6 is coupled to an external drive source, which is a vehicle engine E in this embodiment. A clutch mechanism such as an electromagnetic clutch is not arranged between the drive shaft 6 and the engine E. Therefore, the drive shaft 6 is always driven by the engine E when the engine E is running.

A lug plate 11 is provided in the crank chamber 5 and fixed to the drive shaft 6. The lug plate 11 integrally rotates with the drive shaft 6. A drive plate, which is a swash plate 12 in this embodiment, is provided in the crank chamber 5.

The swash plate 12 is supported by the drive shaft 6. The swash plate 12 moves in the axial direction of the drive shaft 6 and inclines with respect to the surface perpendicular to the axis of the drive shaft 6. The lug plate 11 and the swash plate 12 is coupled by a hinge mechanism 13. Therefore, the swash plate 12 integrally rotates with the lug plate 11 and the drive shaft 6. The swash plate 12 also slides in the axial direction of the drive shaft 6 while inclining with respect to the drive shaft 6.

Cylinder bores 1*a* (only one cylinder bore is shown in the figure) are arranged about the drive shaft 6 extending through the cylinder block 1. Each cylinder bore 1*a* houses a single headed piston 20. The front and rear openings of each cylinder bore 1*a* are closed by the valve plate assembly 3 and the corresponding pistons 20. Each piston 20 and the corresponding cylinder bore 1*a* define a compression chamber, the volume of which is changed according to reciprocation of the piston 20. Each piston 20 is coupled to the periphery of the swash plate 12 by a pair of shoes 19. Therefore, the swash plate 12 converts the rotation of the drive shaft 6 to the reciprocation of the pistons 20 through the shoes 19.

The valve plate assembly 3 and the rear housing 4 define a suction chamber 21 and a discharge chamber 22. The suction chamber 21 is located at the center of the rear housing 4 and the discharge chamber 22 surrounds the suction chamber 21. The suction chamber 21 forms a suction pressure zone, which is exposed to the suction pressure Ps. The discharge chamber 22 forms a discharge pressure zone, which is exposed to the discharge pressure Pd. The valve plate assembly 3 includes a suction port 23, a suction valve 24, a discharge port 25, and a discharge valve 26 for each cylinder bore 1*a*. When each piston 20 moves from the top dead center to the bottom dead center, refrigerant gas in the suction chamber is drawn into the corresponding cylinder bore 1*a* through the corresponding suction port 23 and the corresponding suction valve 24. When each piston 20 moves from the bottom dead center to the top dead center, the refrigerant gas is compressed to a predetermined pressure in the corresponding cylinder bore 1*a*. The compressed refrigerant gas is then discharged to the discharge chamber 22 through the corresponding discharge port 25 and the corresponding discharge valve 26.

(Crank Pressure Control Mechanism)

The inclination angle of the swash plate 12 changes in accordance with the pressure in the crank chamber 5, which is referred to as the crank pressure Pc. A crank pressure control mechanism for controlling the crank pressure Pc includes a bleed passage 27, a supply passage 28, and a control valve CV as shown in FIG. 1. The bleed passage 27 connects the crank chamber 5 to the suction chamber 21. The supply passage 28 connects the discharge chamber 22 to the crank chamber 5. A control valve CV is provided in the supply passage 28. The control valve CV is fitted to a control valve bore 4*a* in the rear housing 4.

Adjusting the opening degree of the control valve CV adjusts the balance of the flow rate of high pressure refrigerant gas supplied into the crank chamber 5 through the supply passage 28 and the flow rate of refrigerant gas bleeded from the crank chamber 5 through the bleed passage 27. This determines the crank pressure Pc. The difference between the crank pressure Pc and the pressure in the cylinder bores 1*a* is changed in accordance with the change in the crank pressure Pc. This changes the inclination angle of the swash plate. As a result, the stroke of the pistons 20, or the displacement of the compressor, is determined.

(Refrigerant Circuit)

As shown in FIG. 1, a refrigerant circuit of a vehicle air-conditioning system includes the compressor and an external circuit 30. The external circuit 30 includes a condenser 31, an expansion valve 32, and an evaporator 33. The external circuit 30 has a low pressure pipe 35, which extends from the evaporator 33 to the suction chamber 21 of the compressor, and a high pressure pipe 36, which extends from the discharge chamber 22 of the compressor to the condenser 31.

A shutter valve 69 is provided in a refrigerant passage between the discharge chamber 22 of the compressor and the condenser 31. When the pressure in the discharge chamber 22 is lower than a predetermined value, the shutter valve 69 closes the passage and stops the flow of refrigerant gas to the external circuit 30.

(Pressure Detecting Structure)

The greater the flow rate of the refrigerant flowing in the refrigerant circuit is, the greater the pressure loss per unit length of the circuit or piping is. That is, when two pressure monitoring points P1 and P2 are provided in the refrigerant circuit, the pressure difference ΔPd between the two points P1 and P2 caused by the pressure loss has a positive correlation with the flow rate of the refrigerant in the circuit. Detecting the pressure difference ΔPd between the two pressure monitoring points P1 and P2 permits the flow rate of refrigerant in the refrigerant circuit to be indirectly detected.

Figure 2:
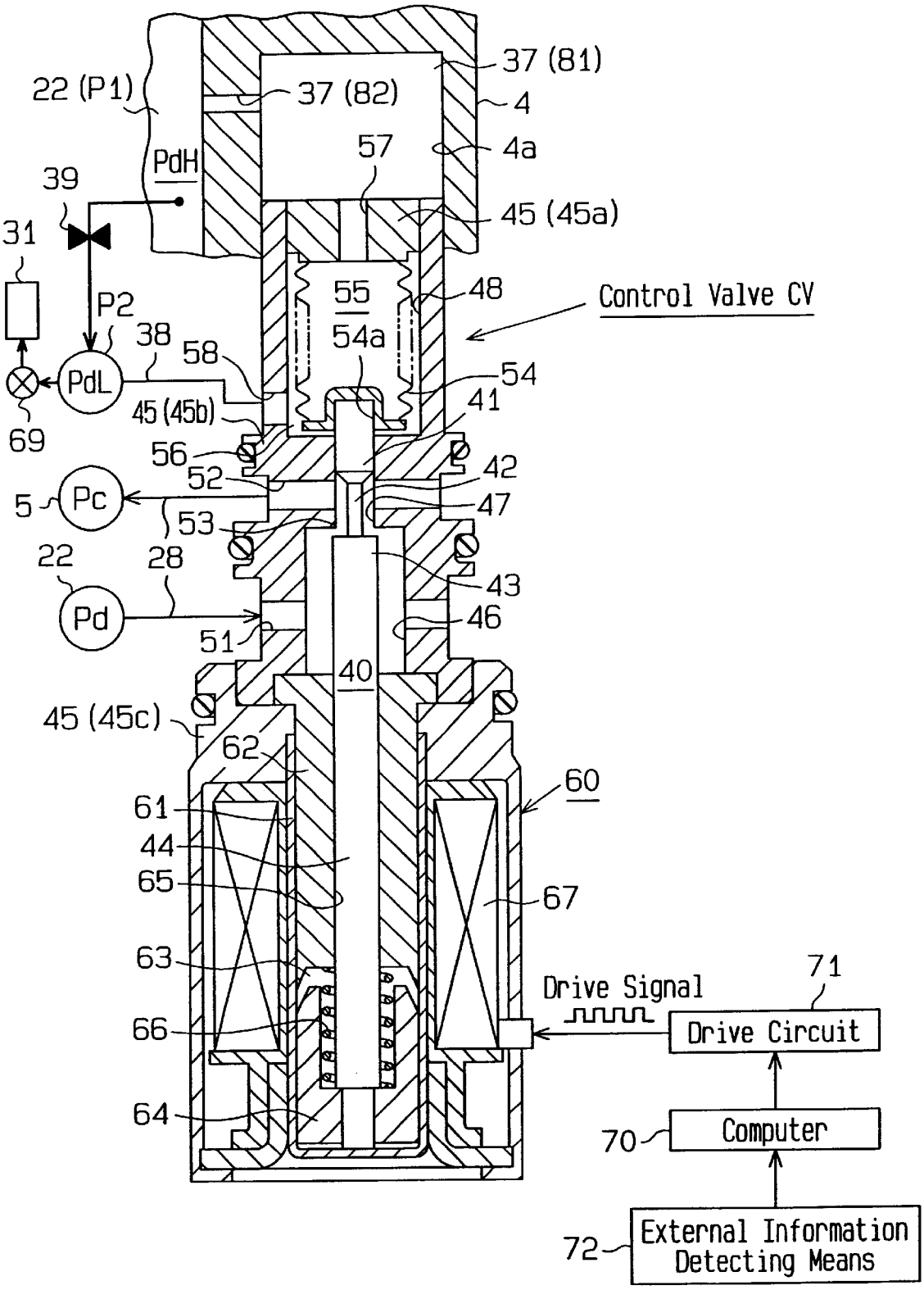
FIG. 2 is a cross-sectional view illustrating a control apparatus according to a first embodiment, which is located in the compressor of FIG. 1.

In this embodiment, a first pressure monitoring point P1 is set up in the discharge chamber 22 corresponding to the most upstream section in the high pressure pipe 36, and a second pressure monitoring point P2 is set up in the refrigerant passage upstream of the shutter valve 69 at a predetermined distance downstream from the first point P1, as shown in FIG. 2. The refrigerant gas pressure at the first pressure monitoring point P1 and that at the second pressure monitoring point P2 are hereinafter referred to as PdH and PdL, respectively. Pressure PdH and the pressure PdL are connected to the control valve CV through a first pressure introduction passage 37 and a second pressure introduction passage 38, respectively.

The refrigerant passage is provided with a fixed restrictor 39 between the first pressure monitoring point P1 and the second pressure monitoring point P2. The fixed restrictor 39 decreases the opening degree of the refrigerant passage. Therefore, the fixed restrictor 39 increases the pressure difference ΔPd between the two pressure monitoring points P1 and P2. This enables the distance between the two pressure monitoring points P1 and P2 to be reduced and permits the second pressure monitoring point P2 to be relatively close to the compressor. Thus, the second pressure introduction passage 38, which extends from the second pressure monitoring point P2 to the control valve CV in the compressor, can be shortened.

(Control Valve)

As shown in FIG. 2, the control valve CV is provided with a supply side valve portion and a target pressure changing member, which is a solenoid 60 in this embodiment. The supply side valve portion is located at the upper side of the control valve CV. The solenoid 60 is located at the lower side of the control valve CV and changes the target pressure. The supply side valve portion adjusts the opening degree of the supply passage 28. The solenoid 60 is an electromagnetic actuator that displaces an operation rod 40 in the control valve CV based on current supplied from the outside. The operation rod 40 includes a separating wall 41, a coupler 42, a guide portion 44. The part of the guide portion 44 adjacent to the coupler 42 functions as a valve body 43.

The control valve CV has a valve housing 45 containing a plug 45*a*, an upper housing member 45*b* and a lower housing member 45*c*. The upper housing member 45*b* constitutes a shell for the supply side valve portion, and the lower housing member 45*c* constitutes a shell for the solenoid 60. The plug 45*a* is press fitted into the upper housing member 45*b* to close an opening in its upper end. A valve chamber 46 and a through hole 47 connected thereto are defined in the upper housing member 45*b*. The plug 45*a* and the upper housing member 45*b* define a pressure sensing chamber 48. The through hole 47 connects the pressure sensing chamber 48 and the valve chamber 46.

The operation rod 40 axially moves in the valve chamber 46 and the through hole 47. That is, the operation rod 40 moves vertically in FIG. 2. The operation rod 40 moves such that the valve body 43 selectively connects and disconnects the valve chamber 46 and the through hole 47. The separating wall 41 is fitted into the through hole 47. The separating wall 41 disconnects the through hole 47 from the pressure sensing chamber 48.

A first port 51 radially extends in the upper housing member 45*b* and is connected to the valve chamber 46. The valve chamber 46 is communicated with the discharge chamber 22 through the first port 51 and the upstream of the supply passage 28. A second port 52 radially extends in the upper housing member 45*b* and is connected to the through hole 47. The through hole 47 is communicated with the crank chamber 5 through the second port 52 and the downstream of the supply passage 28. Therefore, the ports 51, 52, valve chamber 46, and the through hole 47 form a part of the supply passage 28 in the control valve CV.

The valve body 43 is located in the valve chamber 46. The inner wall of the valve chamber 46, in which the through hole 47 is formed, functions as a valve seat 53 that receives the valve body 43. The through hole 47 functions as a valve hole that is selectively opened and closed by the valve body 43. When the operation rod 40 moves from the lowest position of FIG. 2 to the highest position, in which the valve body 43 abuts against the valve seat 53, the through hole 47 is disconnected from the valve chamber 46. That is, the valve body 43 adjusts the opening degree of the supply passage 28.

A pressure sensing member 54, or a bellows, is accommodated in the pressure sensing chamber 48. The pressure sensing member 54 is tubular shape and has a bottom. The upper end of the pressure sensing member 54 is secured to the plug 45*a* by, for example, welding. Therefore, the pressure sensing member 54 defines a first pressure chamber 55 and a second pressure chamber 56 in the pressure chamber 48. The first pressure chamber 55 is the space inside the pressure sensing member 54. The second pressure chamber 56 is the space between the pressure sensing member 54 and the inner wall of the pressure sensing chamber 48. The pressure sensing chamber 48, the pressure sensing member 54, the first pressure chamber 55, and the second pressure chamber 56 form a pressure sensing mechanism.

A rod seat 54*a* is provided at the bottom of the pressure sensing member 54. The rod seat 54*a* has a recess. The distal end of the separating wall 41 of the operation rod 40 is inserted into the recess. The pressure sensing member 54 is elastically deformed during its installation. The pressure sensing member 54 is pressed against the separating wall 41 through the rod seat 54*a* by a force based on the elasticity of the pressure sensing member 54.

The first pressure chamber 55 is communicated with the discharge chamber 22, which is the first pressure monitoring point P1, through a P1 port 57 formed in the plug 45*a* and the first pressure introduction passage 37. The second pressure chamber 56 is communicated with the second pressure monitoring point P2 through a P2 port 58, which is formed in the upper housing member 45*b*, and the second pressure introduction passage 38. That is, the first pressure chamber 55 is exposed to the pressure PdH of the first pressure monitoring point P1 and the second pressure chamber 56 is exposed to the pressure PdL of the second pressure monitoring point P2.

The solenoid 60 has an accommodating cylinder 61 fixed in the lower housing member 45*c*. A fixed iron core 62 is fitted to the upper portion of the accommodating cylinder 61. The fixed iron core 62 defines a plunger chamber 63 in the accommodating cylinder 61. The upper end of the fixed iron core 62 provides a bottom wall of the valve chamber 46. A movable iron core 64 is accommodated in the plunger chamber 63 to be movable in the axial direction. The fixed iron core 62 has a guide hole 65 through which the guide portion 44 of the operation rod 40 is inserted. The movable iron core 64 is secured to the bottom end of the guide portion 44. Therefore, the movable iron core 64 and the operation rod 40 move as a unit.

In the plunger chamber 63, a coil spring 66 is located between the fixed iron core 62 and the movable iron core 64. The coil spring 66 urges the movable iron core 64 apart from the fixed iron core 62. This separates the valve body 43 from the valve seat 53.

A coil 67 is located radially outward of the fixed iron core 62 and the movable iron core 64. A computer 70 sends signals to a drive circuit 71 in accordance with external information from external information detecting means 72. The external information includes the ON/OFF state of an air-conditioning switch, the compartment temperature, and a target temperature. The drive circuit 71 supplies power to the coil 67 in accordance with the signals. The coil 67 generates the electromagnetic force between the movable iron core 64 and the fixed iron core 62 such that the movable iron core 64 moves toward the fixed iron core 62 in accordance with the level of the power. The level of the current supplied to the coil 67 is controlled by adjusting the applied voltage. The applied voltage is adjusted by a pulse-width-modulation, or duty control.

(Operational Characteristics of Control Valve)

The opening degree of the control valve CV is determined by the position of the operation rod 40 as described below.

When no current is supplied to the coil 67, or when duty ratio is zero percent, the downward force of the spring characteristics of the sensing member 54, or the bellows 54, and the coil spring 66 position the rod 40 at the lowest position shown in FIG. 2. Therefore, the distance between the valve body 43 and the through hole 47 is maximum. Thus, the crank pressure Pc is the maximum, which increases the difference between the crank pressure Pc and the pressure in the cylinder bores 1*a*. Accordingly, the inclination angle of the swash plate 12 is the minimum, which minimizes the discharge displacement of the compressor.

When the computer 70 detects that cooling is not needed since the air-conditioning switch is off, or that the cooling is not permitted due to acceleration of a vehicle (demand for stopping cooling for acceleration), the computer 70 sets the duty ratio to zero and minimizes the displacement of the compressor. When the displacement of the compressor is the minimum, the pressure on the discharge chamber 22 side of the shutter valve 69 is less than a predetermined value. Thus, the shutter valve 69 is closed and the flow of refrigerant through the external circuit 30 is stopped. The minimum inclination angle of the swash plate is not zero. Therefore, even when the displacement of the compressor is minimized, the refrigerant is drawn into the cylinder bores 1*a* from the suction chamber 21. Then, the refrigerant is compressed and discharged from the cylinder bores 1*a* to the discharge chamber 22.

Therefore, the refrigerant circuit is formed in the compressor. The refrigerant circuit includes the suction chamber 21, the cylinder bores 1*a*, the discharge chamber 22, the supply passage 28, the crank chamber 5, the bleed passage 27, and the suction chamber 21 in order. Lubricant circulates in the refrigerant circuit with the refrigerant. Therefore, even when refrigerant does not come back from the external circuit 30, each sliding portion such as between the swash plate 12 and each shoe 19 slides smoothly.

When a current having the minimum duty ratio is supplied to the coil 67 (the minimum duty ratio is greater than zero percent), the upward electromagnetic force applied to the coil 67 exceeds the downward force of the pressure sensing member 54 and the coil spring 66. Thus, the operation rod 40 moves upward. The upward electromagnetic force, which is directed oppositely to the downward force of the coil spring 66, counters the downward force of the pressure difference ΔPd. In this case, the downward force of the pressure difference acts in the same direction as the downward force of the pressure sensing member 54. The valve body portion 43 of the operation rod 40 is positioned with respect to the valve seat 53 such that the upward force and the downward force are balanced.

When the rotational speed of the engine E decreases, which decreases the flow rate of refrigerant in the refrigerant circuit, the downward force based on the pressure difference ΔPd decreases. The operation rod 40 moves upward and the opening degree of the through hole 47 decreases. Therefore, the crank pressure Pc decreases, which increases the inclination angle of the swash plate 12. Accordingly, the displacement of the compressor increases. When the displacement of the compressor increases, the flow rate of refrigerant in the refrigerant circuit increases. Accordingly, the pressure difference ΔPd increases.

On the other hand, when the rotational speed of the engine E increases, which increases the flow rate of refrigerant in the refrigerant circuit, the downward force based on the pressure difference ΔPd increases. Accordingly, the operation rod 40 moves downward and the opening degree of the through hole 47 increases. Therefore, the crank pressure Pc increases, which decreases the inclination angle of the swash plate 12. Accordingly the displacement of the compressor decreases. When the displacement of the compressor decreases, the flow rate of refrigerant in the refrigerant passage decreases. Accordingly, the pressure difference ΔPd decreases.

When the duty ratio of the current that is supplied to the coil 67 increases, which increases the upward electromagnetic force, the operation rod 40 moves upward. Accordingly, the opening degree of the through hole 47 decreases, which increases the displacement of the compressor. Therefore, the flow rate of refrigerant in the refrigerant circuit increases, which increases the pressure difference ΔPd.

When the duty ratio of the current that is supplied to the coil 67 decreases, which decreases the electromagnetic force, the operation rod 40 moves downward and the opening degree of the through hole 47 increases. Accordingly, the displacement of the compressor decreases. Therefore, the flow rate of refrigerant in the refrigerant circuit decreases, which decreases the pressure difference ΔPd.

As described above, the control valve CV positions the operation rod 40 according to the fluctuations of the pressure difference ΔPd. The control valve CV maintains the target value, or the target pressure difference, of the pressure difference ΔPd, which is determined by the duty ratio of the current that is supplied to the coil 67. The target pressure difference is externally changed by adjusting the duty ratio. (Feature of First Embodiment)

In the control valve bore 4*a* of the rear housing 4, the plug 45*a* and the upper housing member 45*b* define a chamber 81 at the upper end side of the valve housing 45 as shown in FIG. 2. The chamber 81 is a part of the first pressure introduction passage 37. The chamber 81 expands the opening degree of the first pressure introduction passage 37 at a certain section. A through hole 82 is also a part of the first pressure introduction passage 37. The through hole 82 communicates the discharge chamber 22 and the chamber 81, which are large volume spaces in the rear housing 4. The through hole 82 functions as a pressure reducing mechanism. For example, the through hole 82 has a small diameter and functions as a fixed restrictor.

When no current is supplied to the coil 67 of the control valve CV, the compressor operates with the minimum displacement. In other words, the compressor is operating while its function is stopped. If this state continues for a long time, liquefied refrigerant accumulates in the external circuit 30. When the current supply to the coil 67 is stopped longer than a predetermined time period, the computer 70 restarts the current supply to the coil 67 with the maximum duty ratio regardless of the cooling load.

When the current is supplied to the coil 67 again, the displacement of the compressor increases and the shutter valve 69 opens. Then, the refrigerant circulation via the external circuit 30 starts and the liquefied refrigerant in the external circuit 30 flows into the suction chamber 21 of the compressor. Therefore, the liquefied refrigerant is compressed in the compressor. This increases the pressure in the discharge chamber 22, or the pressure PdH at the first pressure monitoring point P1, abruptly and excessively. As a result, the first pressure chamber 55 in the control valve CV is likely to be affected through the first pressure introduction passage 37.

However, the through hole 82, or the restricting passage 82, in the first pressure introduction passage 37 reduces the pressure increase. The pressure increase of the first pressure chamber 55 is delayed from that of the first pressure monitoring point P1. The pressure difference ΔPd between the first pressure chamber 55 and the second pressure chamber 56 will not be greater than or equal to the maximum target pressure difference. As a result, even when the liquefied refrigerant is compressed, the opening degree of the control valve CV is kept small to increase the pressure difference ΔPd to the target pressure difference. Thus, the displacement of the compressor is promptly increased to a desired degree.

The first embodiment provides the following advantages.

Even when the compressor is started while the liquefied refrigerant is lingering in the refrigerant circuit, the compressor promptly increases the displacement to the desired amount. Therefore, the liquefied refrigerant is promptly discharged outside by the operation of the compressor with the great displacement. The prompt increase of the displacement of the compressor results in a prompt start of the air-conditioning system.

In the prior art, the displacement of the compressor temporarily increases after the compressor is started. However, liquefied refrigerant is sometimes compressed after a short period of time from when the compressor has been started and thus the displacement of the compressor decreases. Therefore, it takes time to stabilize the inclination angle of the swash plate 12 from the start of the pivoting of the swash plate 12. This may cause vibration and noise in the hinge mechanism 13 during the pivoting of the swash plate 12 for a long time. However, in the first embodiment, the time taken to stabilize the inclination angle of the swash plate 12 from the start of the pivoting of the swash plate 12 is reduced. Thus, the vibration and the noise are prevented from continuing for a long time.

Use of the shutter valve 69 permits the use of a clutchless mechanism for the compressor. The shutter valve 69 prevents liquefied refrigerant from flowing into the compressor from the external circuit 30 during the operation of the compressor with the minimum displacement. Therefore, liquefied refrigerant is not compressed during a period from when the compressor is started till the liquefied refrigerant in the external circuit 30 flows into the cylinder bores 1*a*.

The through hole 82 is merely a small diameter passage. Therefore, the pressure increase at the start of the refrigerant circulation is reduced by a simple structure.

The chamber 81 of the first pressure introduction passage 37 reduces the pressure increase in the first pressure chamber 55 more efficiently. In other words, even if the through hole 82 has a large diameter, the desired advantage is obtained by providing the chamber 81. That is, the complicated process to form a restrictor is reduced, which reduces the manufacturing cost. It also prevents foreign particles from clogging in the through hole 82, which has a small diameter. Therefore, a filter for removing foreign particles is not needed. The failure of the pressure sensing mechanism to sense the pressure, that is, the malfunction of the control valve CV, is prevented without a restrictor or a filter.

The chamber 81 is the space formed between the control valve bore 4*a* and the valve housing 45 of the control valve CV, which is inserted in the control valve bore 4*a*. Therefore, no special process is needed for providing the chamber 81, which reduces the manufacturing cost of the compressor.

When no current is supplied to the control valve CV for a long time, the computer 70 determines that there is liquefied refrigerant in the external circuit 30. Thus, the computer 70 restarts the current supply with the maximum duty ratio. Therefore, the computer 70 sets the target pressure difference of the control valve CV when restarting the current supply. Thus, the pressure difference ΔPd is more reliably prevented from exceeding the target pressure difference when starting the compressor.

Second Embodiment

Figure 3:
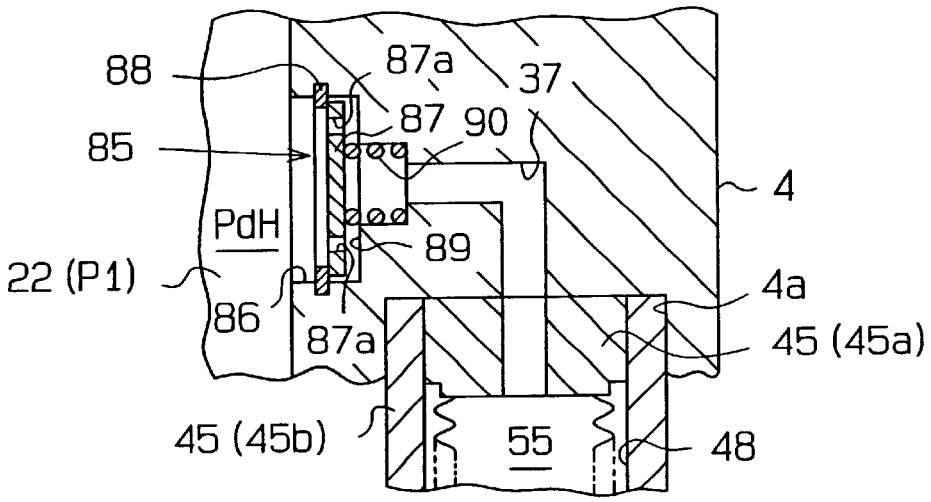
FIG. 3 is an enlarged cross-sectional view illustrating the vicinity of a differential valve of a control apparatus according to a second embodiment.
Figure 4:
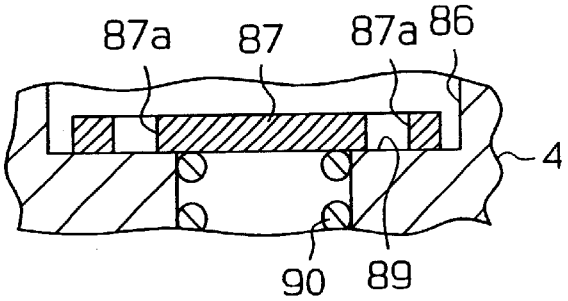
FIG. 4 is a view describing the operation of the differential valve of FIG. 3.

As shown in FIGS. 3 and 4, the pressure reducing mechanism is a differential valve 85 in the second embodiment. That is, a valve chamber 86 is formed on the inner wall of the discharge chamber 22 forming a recess in the rear housing 4. The valve chamber 86 forms a part of the first pressure introduction passage 37. A disk-shaped valve body 87 is accommodated in the valve chamber 86. The valve body 87 abuts against a snap ring 88 such that the valve body 87 does not extend inside the discharge chamber 22. The valve body 87 selectively moves in the direction to contact a valve seat 89 formed in the valve chamber 86 or to be apart from the valve seat 89. A spring 90 is accommodated in the valve chamber 86 and urges the valve body 87 away from the valve seat 89.

Bores 87*a* are formed in the valve body 87 at equal angular intervals. When the valve body 87 is away from the valve seat 89, the discharge chamber 22 and the first pressure chamber 55 are communicated and the first pressure introduction passage 37 is opened (see FIG. 3). When the valve body 87 contacts the valve seat 89, each bore 87*a* is closed by the valve seat 89. Thus, the first pressure introduction passage 37 is closed (see FIG. 4). The contact surface of the valve body 87 and the valve seat 89 is loosely sealed such that the pressure leaks even when the valve body 87 abuts against the valve seat 89.

As described in the first embodiment, when the compressor is started while the liquefied refrigerant is lingering in the refrigerant circuit, the pressure PdH in the discharge chamber 22 increases abruptly and excessively. In this state, the pressure applied to the front surface of the valve body 87, or the surface facing the first pressure chamber 55, which urges the valve body 87 to close, exceeds the pressure applied to the rear surface of the valve body 87, or the surface facing the first pressure chamber 55, which urges the valve body 87 to open. Therefore, the valve body 87 counters the force of the spring 90 and contacts the valve seat 89, as shown in FIG. 4. Thus, the first pressure introduction passage 37 is closed. When the first pressure introduction passage 37 is closed, the pressure increase of the first pressure chamber 55 is less than that of the first pressure monitoring point P1. As a result, the similar advantages as for the first embodiment are obtained.

After a certain time elapses and the pressure difference between the front surface and the rear surface of the valve body 87 is less than a predetermined value, the valve body 87 moves away from the valve seat 89 by the force of the spring 90. Therefore, as shown in FIG. 3, the first pressure introduction passage 37 is open and the fluctuations of the pressure PdH of the discharge chamber 22, or the first pressure monitoring point P1, is promptly transmitted to the first pressure chamber 55. As a result, the response of the operation rod 40 with respect to the fluctuations of the pressure difference ΔPd is improved, which improves the control of the displacement of the compressor.

The second embodiment further provides the following advantages in addition to the above described advantages.

The pressure reducing mechanism is the differential valve 85. The differential valve does not require high accuracy machining such as forming of the first pressure introduction passage 37 in the housing of the compressor. This facilitates the machining of the first pressure introduction passage 37, which reduces the manufacturing cost of the compressor. Similarly to the first embodiment, foreign particles are prevented from clogging. Therefore, a filter for removing foreign particles is not needed. The failure of the pressure sensing mechanism to sense the pressure, that is, the malfunction of the control valve CV, is prevented without machining or a filter.

It should be apparent to those skilled in the art that the present invention may be embodied in many other specific forms without departing from the spirit or scope of the invention. Particularly, it should be understood that the invention may be embodied in the following forms.

Figure 5:
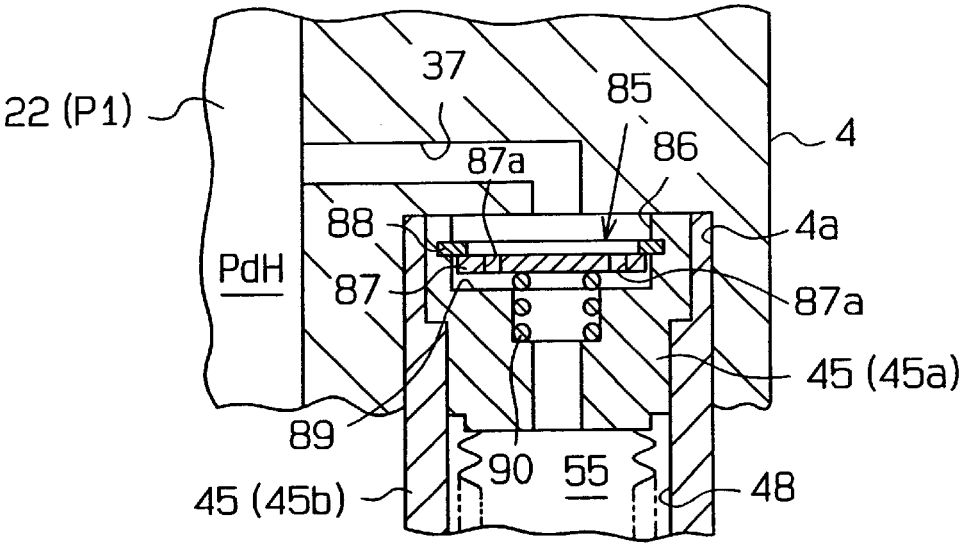
FIG. 5 is a view illustrating further embodiment of the differential valve of FIG. 3.

As shown in FIG. 5, in the second embodiment, the differential valve 85 may be incorporated in the control valve CV (valve housing 45). In this case, the differential valve 85 and the control valve CV may be treated as a unit. This facilitates to attach the differential valve 85 and the control valve CV to the housing of the compressor.

In the first embodiment, the P1 port 57 of the control valve CV may be provided with a fixed restrictor. In this case, the first pressure introduction passage 37 (chamber 81 and the through hole 82, or the restricting passage 82) may be eliminated and the discharge chamber 22 may be directly connected to the first pressure chamber 55 through the P1 port 57. This simplifies the control apparatus.

The second pressure monitoring point P2 may be located in the suction pressure zone between the evaporator 33 and the suction chamber 21 of the refrigerant circuit.

The second pressure monitoring point P2 may be located in the crank chamber 5. That is, the second pressure monitoring point P2 need not be located in a refrigerant cycle that functions as a main circuit of the refrigerant circuit, which includes the external circuit 30 (evaporator 33), the suction chamber 21, the cylinder bores 1*a*, the discharge chamber 22, and the external circuit 30 (condenser 31). In other words, the second pressure monitoring point P2 need not be located in a high pressure zone or a low pressure zone of the refrigerant cycle. For example, the second monitoring point P2 may be located in the crank chamber 5. The crank chamber 5 is an intermediate pressure zone in the refrigerant circuit, which functions as a sub-circuit of the refrigerant circuit and includes the supply passage 28, the crank chamber 5, and the bleed passage 27 in order.

The pressure monitoring point may only be located in the discharge pressure zone of the refrigerant circuit. For example, the second pressure chamber 56 of the control valve CV may be exposed to the vacuum pressure or the atmosphere to keep the pressure in the second pressure chamber 56 substantially constant. In this case, the pressure sensing mechanism moves the operation rod 40 in accordance with the fluctuations of the absolute value of the discharge pressure.

The control valve CV may be used as a bleed side valve, which adjusts the crank pressure Pc by controlling the opening degree of the bleed passage 27.

A clutch mechanism such as an electromagnetic clutch may be provided in a power transmission path between the engine E and the drive shaft 6. In this case, when the electromagnetic clutch is turned on, or when the power transmission is permitted, the compressor is started.

The present invention may be embodied in a wobble-type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A control apparatus for controlling the displacement of a variable displacement compressor that forms a refrigerant circuit of an air-conditioning system, wherein the refrigerant circuit includes the compressor, an external circuit, and a discharge pressure zone, which communicate the compressor and the external circuit and is exposed to refrigerant gas that is discharged from the compressor to the external circuit, the control apparatus comprising:

a control valve, wherein the control valve includes:

a valve housing;

a valve chamber defined in the valve housing;

a valve body located in the valve housing;

a pressure monitoring location in the discharge pressure zone in the refrigerant circuit;

a pressure sensing mechanism, wherein the pressure sensing mechanism includes:

a first and second pressure sensing chamber exposed to the pressure at the pressure monitoring location;

a pressure sensing member for detecting the pressure difference between the first and second pressure sensing chambers, wherein the pressure sensing member is displaced in accordance with the fluctuations of the pressure difference at the pressure monitoring location such that the pressure difference is equal to a target pressure, which is a criteria for determining the position of the valve body, and the valve body moves accordingly to cancel the fluctuations of the pressure and thus the displacement of the compressor is changed; and a target pressure changing member, wherein the target pressure changing member changes the target pressure by controlling the external force applied to the pressure sensing member; and a pressure reducing mechanism for drawing the pressure at the pressure monitoring point to the first pressure sensing chamber, wherein the pressure reducing mechanism is located in a passage that connect the pressure monitoring point and the first pressure sensing chamber, and wherein, when the pressure at the pressure monitoring point abruptly increases, the pressure reducing mechanism reduces the increase of the pressure that is detected by the pressure sensing mechanism.

2. The control apparatus according to claim 1, wherein the pressure reducing mechanism includes a fixed restrictor.

3. The control apparatus according to claim 2, wherein a chamber is located in the passage, wherein said chamber expands the opening degree of the passage at a certain section.

4. The control apparatus according to claim 3, wherein the compressor includes a housing to accommodate the control valve, wherein the chamber is a space formed between the housing of the compressor and the valve housing of the control valve.

5. The control apparatus according to claim 1, wherein the pressure reducing mechanism includes a differential valve, wherein, when the difference between the pressure at the pressure monitoring location and the pressure at the pressure sensing mechanism is greater than or equal to a predetermined value, the differential valve decreases the opening degree of the passage.

6. The control apparatus according to claim 1, wherein a chamber is located in the passage, wherein said chamber expands the opening degree of the passage at a certain section.

7. The control apparatus according to claim 6, wherein the compressor includes a housing to accommodate the control valve, wherein the chamber is a space formed between the housing of the compressor and the valve housing of the control valve.

8. The control apparatus according to claim 1, wherein the pressure reducing mechanism is located in the valve housing.

9. The control apparatus according to claim 1, wherein the pressure monitoring location is a first pressure monitoring point, and a second pressure monitoring point is located at a lower pressure side than the first pressure monitoring point in the refrigerant circuit.

10. The control apparatus according to claim 9, wherein the second pressure monitoring point is located in the discharge pressure zone of the refrigerant circuit.

11. The control apparatus according to claim 1, wherein the refrigerant circuit connects the compressor and the external circuit, and further includes a suction pressure zone, which is exposed to refrigerant gas drawn into the compressor from the refrigerant circuit, wherein the compressor includes a crank chamber, a supply passage, which connects the crank chamber to the discharge pressure zone, and a bleed passage, which connects the crank chamber to the suction pressure zone, wherein the variable displacement compressor changes the displacement of the compressor by adjusting the pressure in the crank chamber.

12. The control apparatus according to claim 11, wherein the control valve adjusts the opening degree of the supply passage.

13. The control apparatus according to claim 1, wherein the target pressure changing member includes an electromagnetic actuator, to which current is supplied from outside.

14. The control apparatus according to claim 1, wherein the sensing member is a bellows.

15. The control apparatus according to claim 1, wherein the compressor is directly connected to an external drive source, which drives the compressor, such that the power is transmitted.

* * * * *